US006223964B1

(12) United States Patent
Müller

(10) Patent No.: US 6,223,964 B1
(45) Date of Patent: May 1, 2001

(54) DEVICE FOR LONGITUDINALLY STITCHING MULTIPIECE PRINTED PRODUCTS

(75) Inventor: Holger Müller, Taucha (DE)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/423,024

(22) PCT Filed: Mar. 23, 1998

(86) PCT No.: PCT/CH98/00115

§ 371 Date: Oct. 28, 1999

§ 102(e) Date: Oct. 28, 1999

(87) PCT Pub. No.: WO98/50240

PCT Pub. Date: Nov. 12, 1998

(30) Foreign Application Priority Data

May 7, 1997 (CH) ..... 1068/97

(51) Int. Cl.[7] ..... B27F 7/17; B42B 4/02

(52) U.S. Cl. ..... 227/81; 227/100; 270/37; 270/58.18

(58) Field of Search ..... 227/81, 88, 100, 227/155; 270/37, 58.08, 52.18; 412/33

(56) References Cited

U.S. PATENT DOCUMENTS

| | | | | |
|---|---|---|---|---|
| 3,762,622 | * | 10/1973 | Noren | 227/81 |
| 4,204,626 | * | 5/1980 | Kutzner et al. | 227/81 |
| 4,315,588 | * | 2/1982 | Faltin | 227/81 |
| 4,792,077 | * | 12/1988 | Faltin | 227/81 |
| 5,172,897 | * | 12/1992 | Hansch et al. . | |
| 5,174,557 | * | 12/1992 | Meier | 270/37 |
| 5,342,032 | * | 8/1994 | Meier | 227/81 |
| 5,356,125 | * | 10/1994 | Hansch et al. | 227/81 |
| 5,464,199 | * | 11/1995 | Stauber | 227/81 |
| 5,590,828 | | 1/1997 | Stauber . | |
| 5,772,195 | * | 6/1998 | Mueller . | |

FOREIGN PATENT DOCUMENTS

| | | |
|---|---|---|
| 27 55 209 | 6/1979 | (DE) . |
| 0 399 317 A1 | 11/1990 | (EP) . |
| 0 606 555 A1 | 7/1994 | (EP) . |
| 0 691 215 A1 | 1/1996 | (EP) . |

* cited by examiner

*Primary Examiner*—Scott A. Smith
(74) *Attorney, Agent, or Firm*—Alston & Bird LLP

(57) ABSTRACT

A rotating stitcher 4 for driving U-shaped wire stitches 43 into printed products 3 being conveyed along a linear path, wherein a stapling closing device 5 cooperates with the stitcher 4, for closing the wire stitches 43. The rotating stitcher 4 has stitching heads 7 which are hinged around a rotating support 6. A control device guarantees that the stitching heads 7 are swung into a position where the direction of displacement E of the stitch plunger 10 is at right angles to the direction of transport A of the products 3 to be stitched. This takes place before or during entry of the stitching head 7 into the stitching area. While the wire stitches are driven in and stitched, the stitching heads 7 are held in this position and thus move linearly in the stitching area. The heads 32 of the stapling closing device 5 are guided in the same way, so that they move linearly during stapling, just like the allocated staple head 7.

14 Claims, 11 Drawing Sheets

DEVICE FOR LONGITUDINALLY STITCHING MULTIPIECE PRINTED PRODUCTS

BACKGROUND OF THE INVENTION

The present invention relates to a device for the longitudinal stitching of multipiece printed products.

U.S. Pat. No. 4,204,626 discloses a wire-stitching device of this type in which a rotationally driven rotary stitcher is assigned to a stitching-hook closing arrangement, which is formed by a likewise rotationally driven stitching-hook closing cylinder. The axes of rotation of the stitcher and the stitching-hook closing cylinder are parallel to one another and run at right angles to the conveying direction of the products to be stitched. The rotary stitcher has a cylindrical carrier, in which a guide bush for a displaceable stitching-hook drive-in plunger is arranged, the guide bush running in the radial direction. The guide bush, which is rotatable about its radial longitudinal axis, is held in a fixed position in the radial direction in the carrier.

When the rotating stitching head meets the product advanced along an essentially rectilinear path, the U-shaped stitching hook transported by the stitching head is driven into the product in such a way that first one stitching-hook leg and then the other stitching hook leg penetrates the product and passes through the latter. During the driving-in operation, the position of the stitching-hook legs changes relative to the product. The stitching-hook legs are then bent. To this end, the stitching-hook closing cylinder has two bending elements, of which one is attached to the stitching-hook closing cylinder in a fixed position and the other is attached to the stitching-hook closing cylinder in a rotational manner. The two bending elements, as viewed in the direction of rotation of the stitching-hook closing cylinder, are arranged one behind the other in such a way that the leading bending element comes into effect on the leading leg of the stitching hook and the trailing bending element comes into effect on the trailing leg of the stitching hook.

The object of the present invention, then, is to provide a longitudinal-stitching device of the type mentioned at the beginning which enables the legs of the stitching hooks to be driven at high speed into the products simultaneously and essentially in an approximately right-angled direction relative to the products.

SUMMARY OF THE INVENTION

The above and other objects and advantages of the present invention are achieved by the provision of a rotating stitcher which is provided with at least one stitching head for setting wire stitching hooks in the products. Each stitching head includes a pivotally mounted guide which extends essentially radially to the axis of rotation of the stitcher, and a displaceable stitching-hook drive-in plunger is mounted in each guide. A control arrangement is provided for pivoting each pivotally mounted guide during rotation of the stitcher, and each guide together with the guide together with the stitching-hook drive-in plunger, in the stitching region, is held over a certain section in a position in which the displacing direction of the stitching-hook drive-in plunger is approximately at right angles to the conveying direction of the products, which enables the wire stitching hooks to be satisfactorily driven in with both stitching-hook legs simultaneously without the direction of the stitching-hook legs changing relative to the product during the driving-in operation. The closing of the set stitching hooks, i.e. the bending of the two stitching-hook legs, may be effected in a simple manner, since the stitching hooks perform a linear movement during the closing operation.

Two or more stitching heads per stitcher of the type defined above are preferably provided, and these stitching heads in each case interact in the stitching region with linearly moving bending members of the stitching-hook closing arrangement.

Further preferred developments of the longitudinal-stitching device according to the invention are outlined in the following detailed description of the invention.

BRIEF DESCRIPTION OF THE DRAWINGS

Exemplary embodiments of the subject matter of the invention are explained in more detail below with reference to the drawings, in which, in a purely schematic manner.

DETAILED DESCRIPTION OF THE PREFERRED EMBODIMENTS

Figure 1:
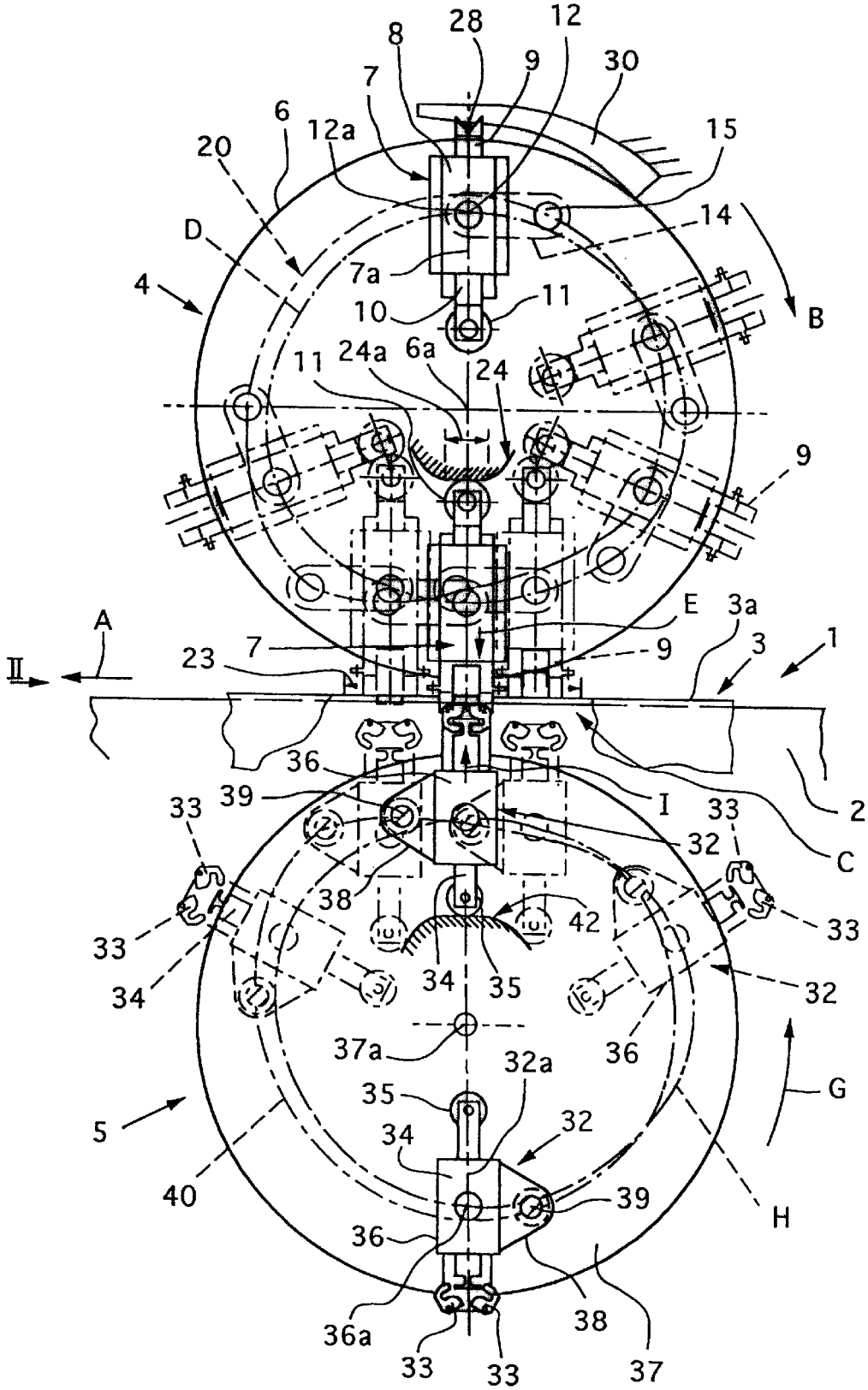
FIG. 1 in side view.
Figure 2:
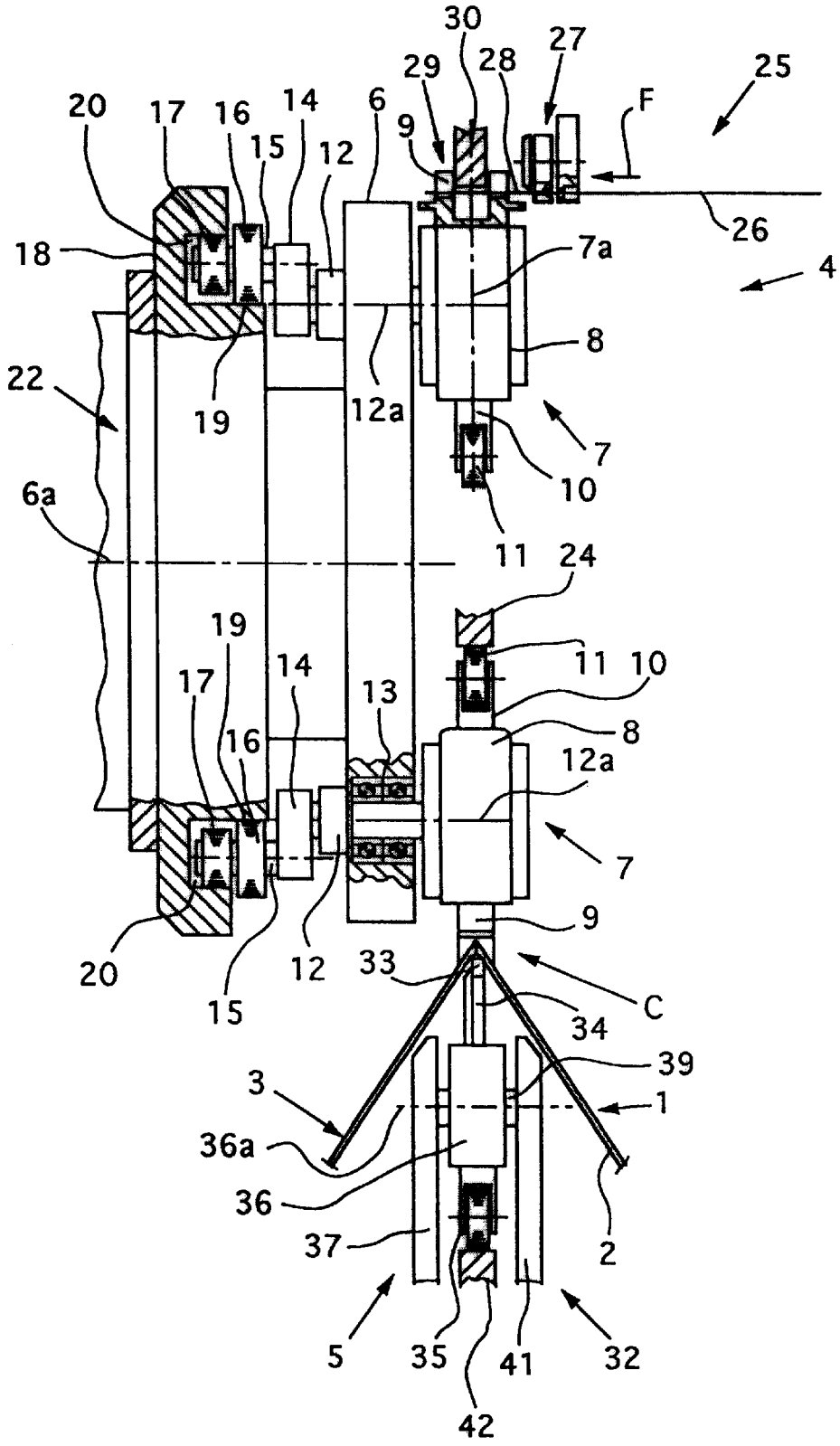
FIG. 2 in front view in the direction of arrow II in FIG. 1, show a first embodiment of a longitudinal-stitching device according to the invention.

Shown in FIGS. 1 and 2 is a collecting section 1, which has a saddle 2 in a manner known per se. The printed product 3 to be stitched, which consists of a plurality of superimposed folded sheets, rests on the saddle 2 in a straddling manner and is continuously fed forward in the direction of arrow A. The folding edge 3*a* of the printed product 3 therefore runs in the conveying direction A. Available for the stitching of the printed product 3 is a longitudinal-stitching device, which in the exemplary embodiment shown in FIGS. 1 and 2 has a rotating stitcher 4 as well as a stitching-hook closing arrangement 5, which is opposite the rotating stitcher 4 relative to the saddle 2.

The rotating stitcher 4 has a disk-shaped carrier 6, which is rotationally driven about the axis 6*a* in the direction of arrow B. In this case, the axis of rotation 6*a* of the carrier 6 runs at right angles to the conveying direction A of the printed product 3. Two stitching heads 7, whose longitudinal axes are designated by 7*a*, are attached diametrically opposite one another to the carrier 6. Each stitching head 7 has a housing 8, in which a stitching-hook guide 9 is arranged, and this stitching-hook guide 9 extends in the stitching-head longitudinal axis 7*a* and is mounted in the housing 8 in such a way that it can be pushed back against the force of springs (not shown) The stitching-hook guide 9 serves as a guide for a stitching-hook drive-in plunger 10, which carries a control roller 11 on its one free end. For the more detailed construction of the stitching heads 7, i.e. of the arrangement of the stitching-hook guide 9 and the stitching-hook drive-in plunger 10 in the interior of the housing 8, reference is made to U.S. Pat. No. 5,464,199.

The housing 8 carries a journal 12, which is rotatably mounted in the carrier 6 by means of ball bearings 13 FIG. 2. The longitudinal axis of the journal 12 forms the pivot axis 12*a* for the housing 8 and thus for the stitching head 7. Firmly connected to the journal 12 is a control lever 14, which at its other end carries a spindle 15, on which two control rollers 16 and 17 are rotatably mounted. Serving to control the pivoting movement of the housing 8 is a fixed disk cam 18 (FIG. 2), which has a running surface 19 for the control rollers 16 and a control groove 20 for the control rollers 17. The path of the control groove 20 and accordingly of the running surface 19 is indicated by a dash-dotted line in FIG. 1 and is likewise designated by 20. As FIG. 2 also shows, the carrier 6 sits on a driven drive shaft 22, which passes through the disk cam 18.

The pivot axes 12*a* of the housings 8, during the rotation of the carrier 6, move along a circular path, which is designated in FIG. 1 by D. The control groove 20 has such a path that the stitching heads 7 or their housings 8 extend approximately in the radial direction during the rotation of the carrier 6 and, before or during entry into the stitching region C, are pivoted into a position in which the longitudinal axis 7*a* of the stitching heads 7 runs essentially at right angles to the conveying direction A and thus to the folding edges 3*a* of the printed products 3. Furthermore, due to the special design of the cam path 20, a situation is achieved in which the stitching heads 7 in the stitching region C, i.e. when passing through a section designated by 23 in FIG. 1, maintain this position, as shown in FIG. 1 by the stitching-head positions depicted by dash-dotted lines. After leaving the stitching region C, the housings 8 and thus the stitching heads 7 are swung back into the radial position again.

While the stitching heads 7 are passing through the stitching region C, a fixed control link 24 comes into effect on the control rollers 11 of the stitching-hook drive-in plunger 10, which results in a displacement of the stitching-hook drive-in plunger 10 in its longitudinal direction, which coincides with the longitudinal axis 7*a* of the stitching heads 7, i.e. in the direction of arrow E. The control link 24 has a section which is designated by 24*a* and runs parallel to the conveying direction A of the printed product 3.

Opposite the stitching region C, a stitching-wire feed 25 is arranged adjacent to the carrier 6. The stitching wire 26 is fed forward in the direction of arrow F by feed means (not shown) and fed to a wire cutter 27. The latter cuts off wire sections 28 from the stitching wire 26, and these wire sections 28 are received at a wire-transfer point 29 by the stitching heads 7 running past, i.e. by the stitching-hook guides 9. Arranged downstream of the stitching-wire feed 25 as viewed in the direction of rotation B of the carrier 6 is a fixed wire-bending link 30, which serves to bend the straight wire section 28 received into U-shaped stitching hooks, which are held in the stitching-hook guides 9 of the stitching heads 7.

As can be seen in particular from FIG. 2, the stitching wire 26 in the exemplary embodiment shown is fed in a direction F, which is at right angles to the feeding direction A of the printed products 3 and thus at right angles to the folding edge 3*a* of the printed products 3. This means that the stitching-hook guide 9, during its movement from the wire-transfer point 29 to the stitching region C, must be rotated by 90° about its longitudinal axis, i.e. about the longitudinal axis 7*a* of the stitching heads 7, so that the stitching hooks can be driven in the direction of the folding edge 3*a* into the printed product 3. The rotary mechanism for such a rotation of the stitching-hook guides 9 is not shown in FIGS. 1 and 2. In this connection, however, reference is made to FIG. 25, in which a possible design of such a rotary mechanism is shown.

However, it is also possible to feed the wire sections 28 to the stitching heads 7 in a direction which runs parallel to the conveying direction A of the printed products 3. In addition, instead of straight wire sections 28, which then have to be bent into a U-shape, finished stitching hooks which are already U-shaped may be delivered to the stitching heads 7.

The stitching-hook closing arrangement 5 has two stitching-hook closing heads 32, which are likewise diametrically opposite one another and whose longitudinal axes 32*a*, just as with the stitching heads 7, normally run in the radial direction. Each stitching head has two bending elements 33, which are mounted in an articulated manner and are pivoted from the rest position into the operative position by means of an actuating plunger 34. The actuating plungers 34 carry a control roller 35 at one end and are guided in a housing 36 so as to be displaceable in the longitudinal direction 32*a* of the stitching-hook closing heads 32, i.e. in the direction of the arrow I. The housing 36 is fastened to a carrier 37 so as to be pivotable about an axis designated by 36*a*, the carrier 37 being rotationally driven about the axis 37*a* in the direction of arrow G. Attached to each housing 36 is a control lever 38, which carries a pin 39 at its free end, and this pin 39 engages in a groove 40 (only indicated by a dash-dotted line in FIG. 1) by means of a control roller (not shown). This groove 40 is formed on a fixed disk cam 41 (FIG. 2).

While the pivot axes 36*a* of the stitching-hook closing heads 36 are moved along a circular path of movement H, the control rollers of the pins 39 move along a path which is established by the control groove 40 and has such a shape that the stitching-hook closing heads 32, before or when running into the stitching region C, are pivoted into a position in which the longitudinal axis 32*a* of the stitching-hook closing heads 32 and thus the displacing direction I of the actuating plungers 34 are at right angles to the conveying direction A of the printed products 3 and thus at right angles to the folding edge 3*a* of the printed products 3. The stitching-hook closing heads 32 are held in this position in the stitching region C while passing through the section 23 already mentioned. This means that the stitching-hook closing heads 32, in the same way as the stitching heads 7, perform a linear movement, which runs parallel to the conveying direction A of the printed products 3, along the section 23.

For the displacement of the actuating plunger 34 in the stitching region C, there is a control link 42, which comes into effect on the control roller 35 of the actuating plunger 34.

The stitching operation, in so far as it does not already follow from the preceding description, is explained in more detail with reference to FIGS. 3–8 and to FIGS. 1 and 2.

Figure 5:
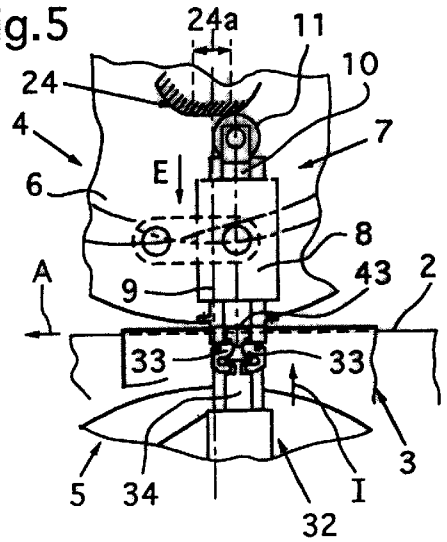
FIGS. 3–8 show various phases of the stitching-hook closing and setting operation in the device according to FIGS. 1 and 2, FIGS. 9–15 show various arrangements and possible uses of a stitching device or a plurality of stitching devices of the type according to the invention.
Figure 8:
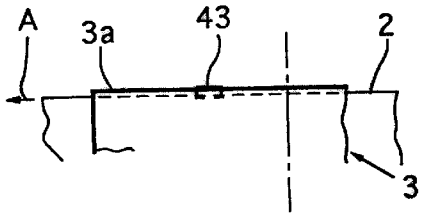
Figure 4:
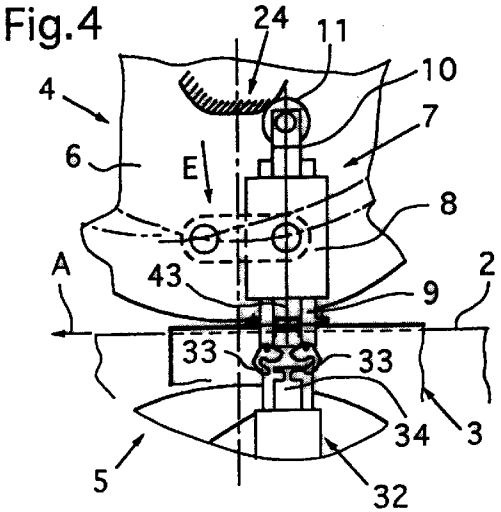
Figure 7:
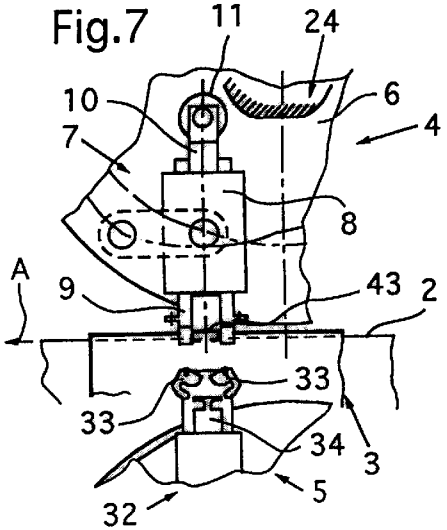
Figure 3:
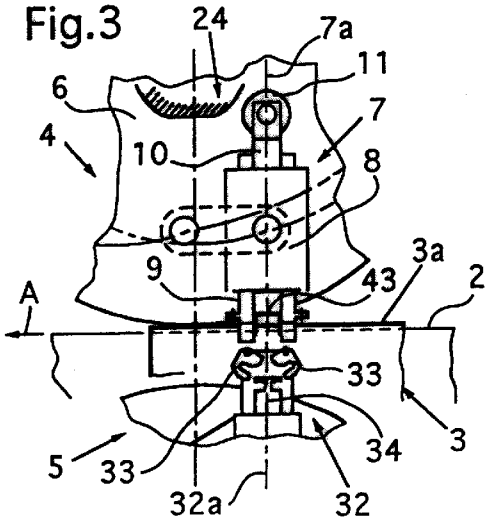
Figure 6:
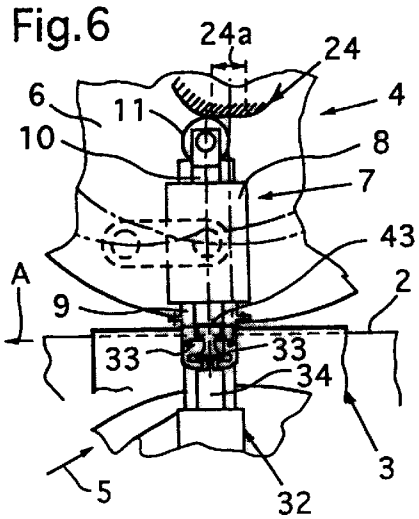

As already mentioned, each stitching head 7 and the associated stitching-hook closing head 32, before or when running into the stitching region C, are pivoted into a position in which the longitudinal axis 7*a* or 32*a* of the stitching head 7 or the stitching-hook closing head 32 respectively runs approximately at right angles to the conveying direction A and thus to the folding edge 3*a* of the printed product 3 to be stitched. Since the flight path of the stitching-hook guides 9 of the stitching heads 7 intersects the rectilinear path of movement of the folding edge 3*a* of the printed product 3, i.e. the top edge of the saddle 2, the stitching-hook guides 9 guiding the U-shaped stitching hooks 43 are pushed back against a resilient restoring force relative to the stitching-hook drive-in plungers 10, as explained in more detail in U.S. Pat. No. 5,464,199 already mentioned. The stitching hook 43 guided in the stitching-hook guide 9 extends in the direction of the folding edge 3*a* of the printed product 3 (FIG. 3). As soon as the control roller 11 of the stitching-hook drive-in plunger 10 starts to run onto the control link 24, the stitching-hook drive-in plunger 10 is displaced downward in the direction of arrow E, the result of which is that the stitching hook 43 is simultaneously driven with both legs into the printed product 3 in the region of the folding edge 3*a* (FIG. 4). In FIG. 5, the stitching-hook drive-in plunger 10 is shown in its bottom end position, in which it has pushed the stitching hooks 43 completely into the printed product 3. During the rectilinear drive-in section, designated by 24*a* in FIGS. 1, 5 and 6, of the control link 24, the stitching-hook drive-in plunger 10 remains in this bottom end position. The actuating plunger 34 of the stitching-hook closing head 32 is at the same time moved upward in the direction of arrow I. The result of this is that the bending elements 33 are pivoted into the operative position and are brought into effect on the stitching-hook legs (FIGS. 5 and 6). During the simultaneous bending of the stitching-hook legs, the stitching-hook drive-in plunger 10 remains in the abovementioned bottom end position. After completion of the stitching-hook setting and closing operation, the control rollers 11 and 35 of the stitching-hook drive-in plunger 10 and the actuating plunger 34 respectively run off the associated control links 24 and 42 respectively. The stitching-hook drive-in plunger 10 and the actuating plunger 34 are moved back (FIG. 7). The stitching head 7 and the associated stitching-hook closing head 23 are then swung back into the radial position again. Part of the printed product 3 with the finished stitching hook 43 is shown in FIG. 8.

The stitching hooks 43 are set and closed in the stitching region C during a linear movement of the stitching hooks 43 along the section 23. As mentioned, both the stitching head 7 and the stitching-hook closing head 32 interacting with it are controlled in such a way that their movement along the abovementioned section 23 is likewise linear.

Figure 9:
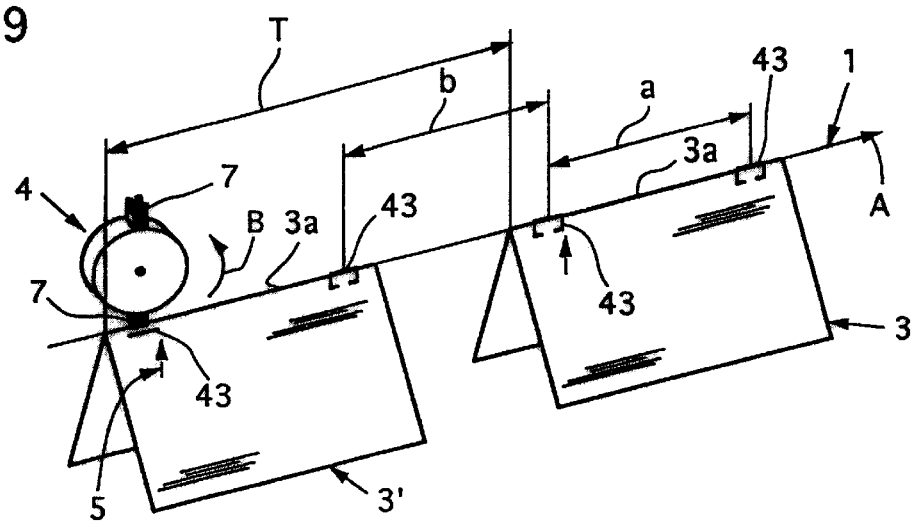
Figure 10:
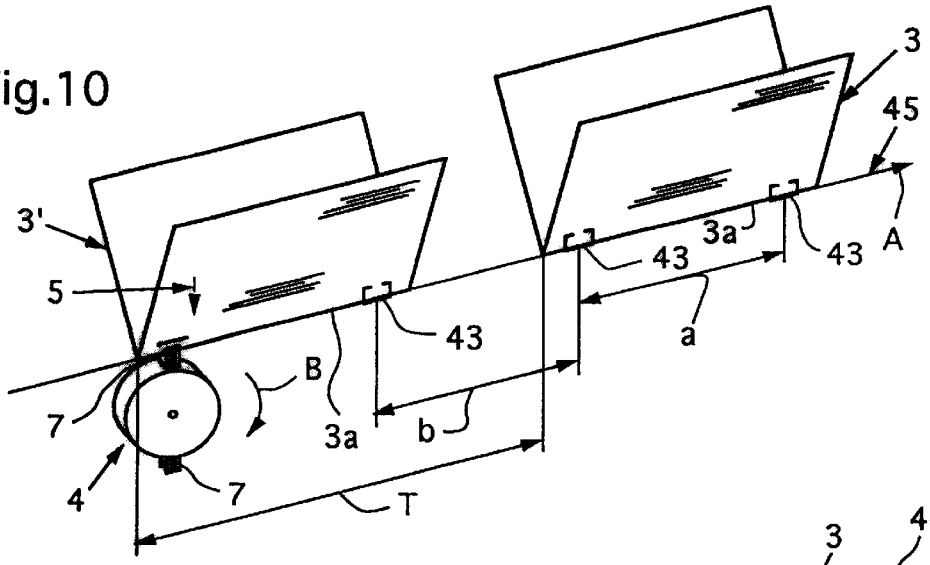
Figure 11:
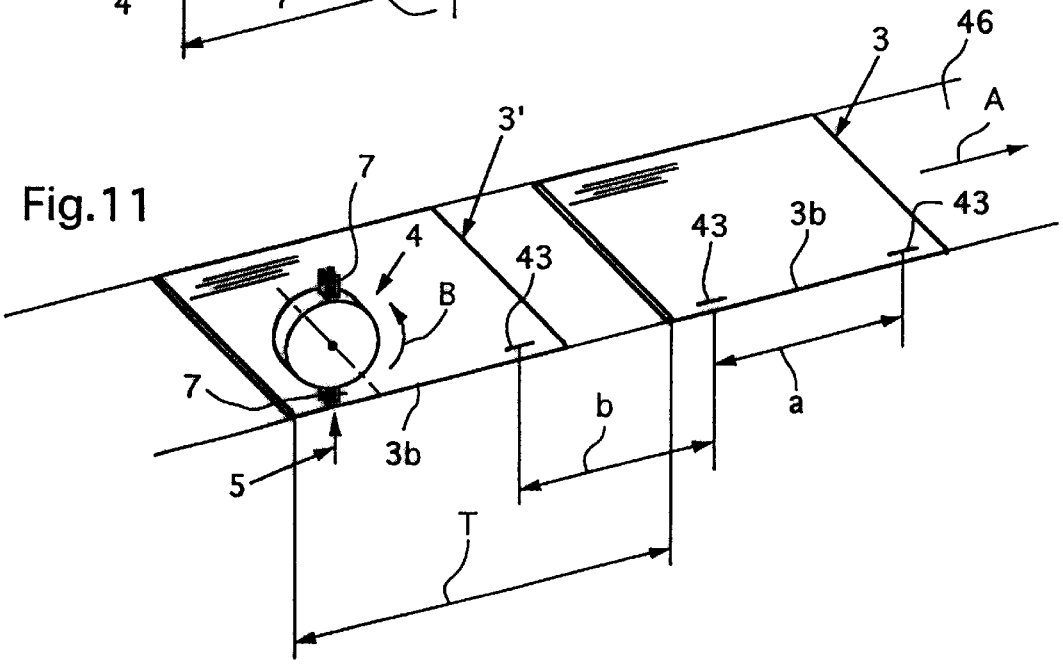

Various conveying systems for the printed products 3 to be stitched are shown in FIGS. 9–11, there being in each case a longitudinal-stitching device of the type as has been explained with reference to FIGS. 1 and 2.

In the embodiment according to FIG. 9, the printed products 3, 3' as explained with reference to FIGS. 1–8, are conveyed along a collecting section 1. At a collecting section 1, the multipiece, folded printed products 3, 3', are produced by placing the folded individual sheets one on top of the other. The end products are therefore put together from inside to outside.

In FIG. 10, the printed products 3, 3' to be stitched are moved along an insertion section 45. This insertion section 45 has a V-shaped passage, which is open at the top and into which the folded individual sheets are placed one inside the other with their folding edge 3*a* underneath. During the insertion, the end product 3, 3' is put together from outside to inside. In the case of the insertion section 45 shown in FIG. 10, in contrast to the embodiment according to FIG. 9, the rotating stitcher 4 is located below the insertion section 45.

In the embodiment according to FIG. 11, the printed products 3, 3' to be stitched are conveyed resting on a belt conveyor 46. The end products 3, 3' may consist of folded or unfolded individual leaves or sheets placed one on top of the other. However, it is also conceivable to convey multipiece printed products 3, 3' consisting of folded sheets lying one inside the other on the belt conveyor 46. In any case, the products 3, 3' to be stitched are transported in such a way that that side edge 3*b* of the printed products 3, 3' along which the stitching hooks 43 are to be set run parallel to the conveying direction A.

In all three FIGS. 9–11, the distance between the two stitching hooks 43 of each printed product 3, 3' is designated by a. This distance a corresponds to the distance between the ends of the stitching heads 7 as measured in the circumferential direction of the carrier 6. In this case, it is assumed that the circumferential velocity of the stitching-head ends and the conveying speed of the printed products 3, 3' are the same. The distance b between the rear stitching hook 43 of the leading product 3 and the front stitching hook 43 of the following printed product 3' is designated by b and corresponds to the stitching hook distance a. However, the distance b may also be an integral multiple of the distance a. The distance between successive products 3 and 3' is designated by T.

Figure 12:
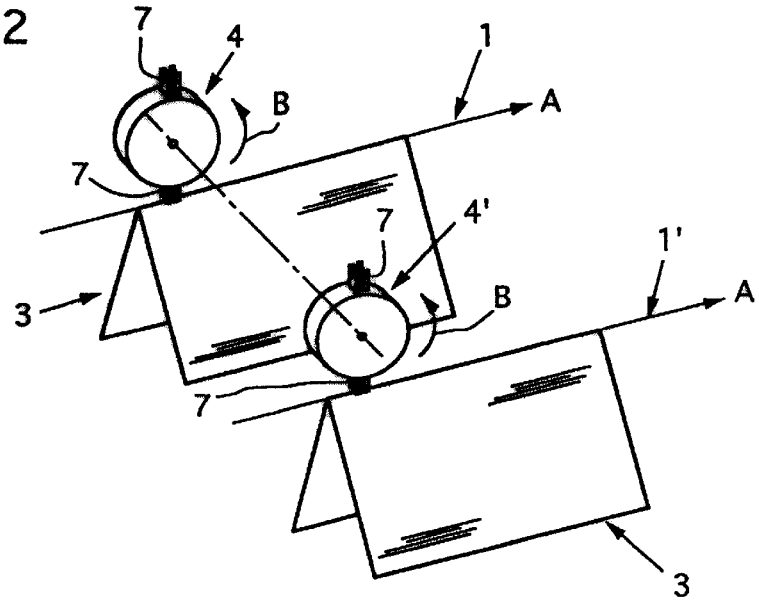
Figure 13:
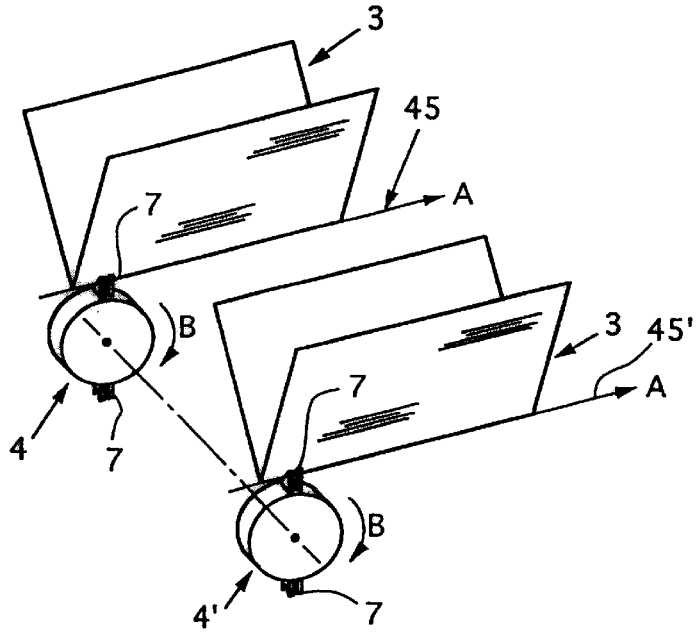

Shown in FIGS. 12 and 13 are two collecting sections 1 and 1' (FIG. 12) and respectively two insertion sections 45, 45' (FIG. 13) which run parallel to one another. Assigned to each collecting section 1, 1' or insertion section 45, 45' respectively is a longitudinal stitcher, of which only the rotating stitcher 4, 4' is shown. The products 3 are stitched simultaneously on both transport sections 1, 1' and 45, 45' respectively.

Figure 14:
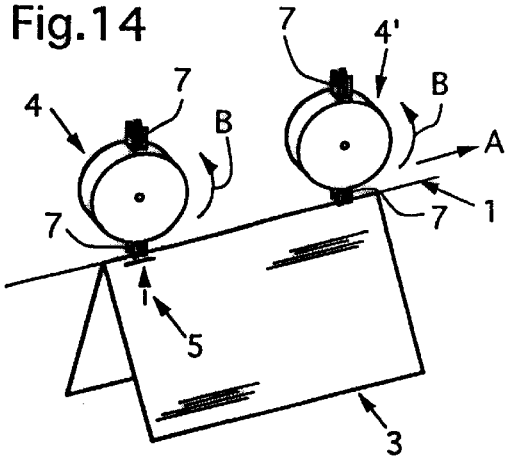
Figure 15:
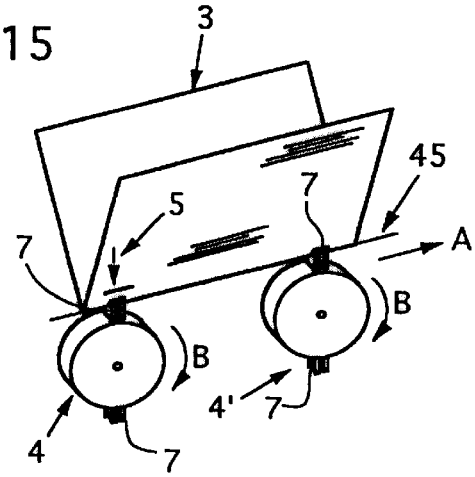

Shown in FIGS. 14 and 15 are a collecting section 1 (FIG. 14) and an insertion section 45 (FIG. 15) respectively. There are two longitudinal-stitching devices, working in synchronism with one another, of the type shown in FIGS. 1 and 2 at each conveying section 1, 45. The two stitchings for each printed product 3 are effected simultaneously. The distance between the two longitudinal-stitching devices may be set in order to change the distance between the two stitching hooks of each product 3 and in order to permit a changeover to other product formats.

Figure 16:
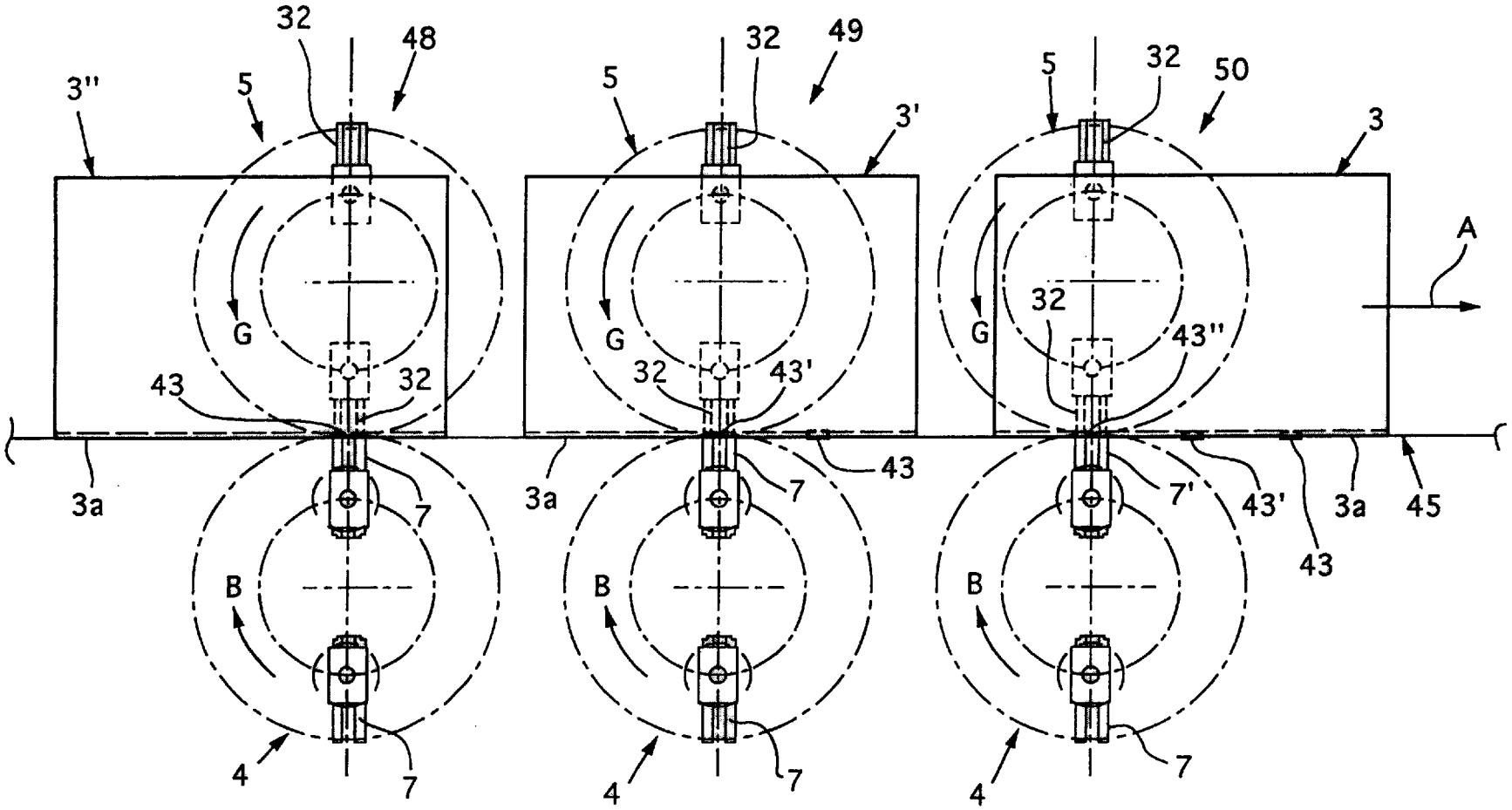
FIGS. 16–19 show a stitching arrangement with three longitudinal-stitching devices according to the invention in various working phases.

Shown in FIG. 16 is an embodiment in which not only one longitudinal-stitching device but three longitudinal stitchers 48, 49, 50 working in synchronism with one another are arranged along an insertion section 45 as has already been explained with reference to FIG. 10. Each stitcher 48, 49, 50 is constructed as explained with reference to FIGS. 1 and 2, although the positions of the rotating stitchers 4 and of the associated stitching-hook closing arrangements 5 are reversed compared with the representation in FIGS. 1 and 2.

Three stitching hooks 43, 43' and 43" are set at each product, specifically in a consecutive sequence, by means of the three longitudinal stitchers 48, 49 and 50. The longitudinal stitcher 48 sets the frontmost stitching hook 43 as viewed in the conveying direction A of the printed products 3, 3', 3". The centre stitching hook 43' is then set by the stitcher 49. During the passage through the longitudinal stitcher 50, the third, rearmost stitching hook 43" is set. As mentioned, the setting and closing of the three stitching hooks 43, 43' and 43" are effected simultaneously, but in each case at a different product 3, 3' and 3" respectively.

Figure 17:
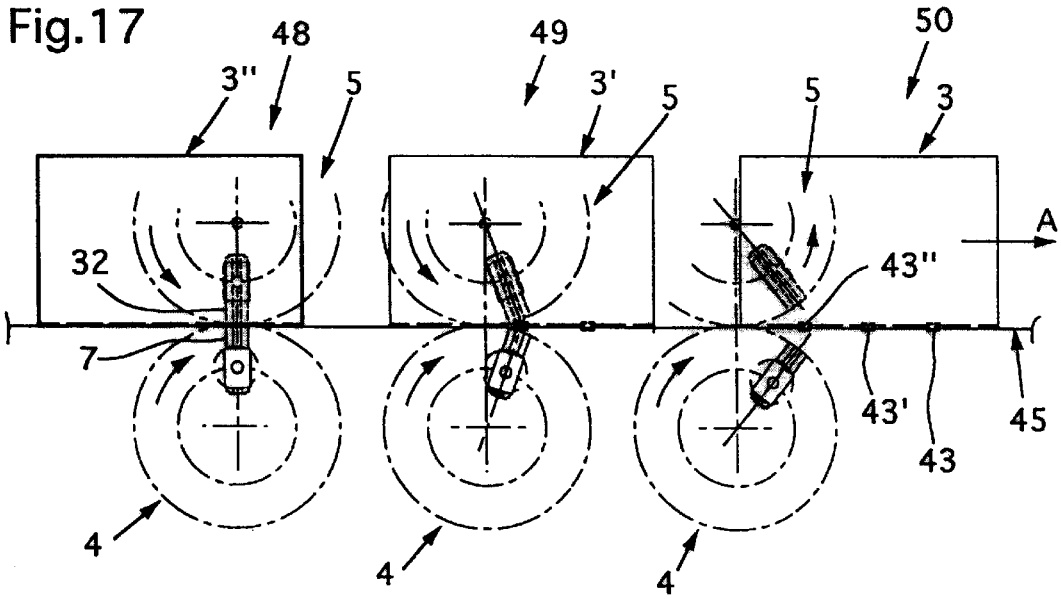
Figure 18:
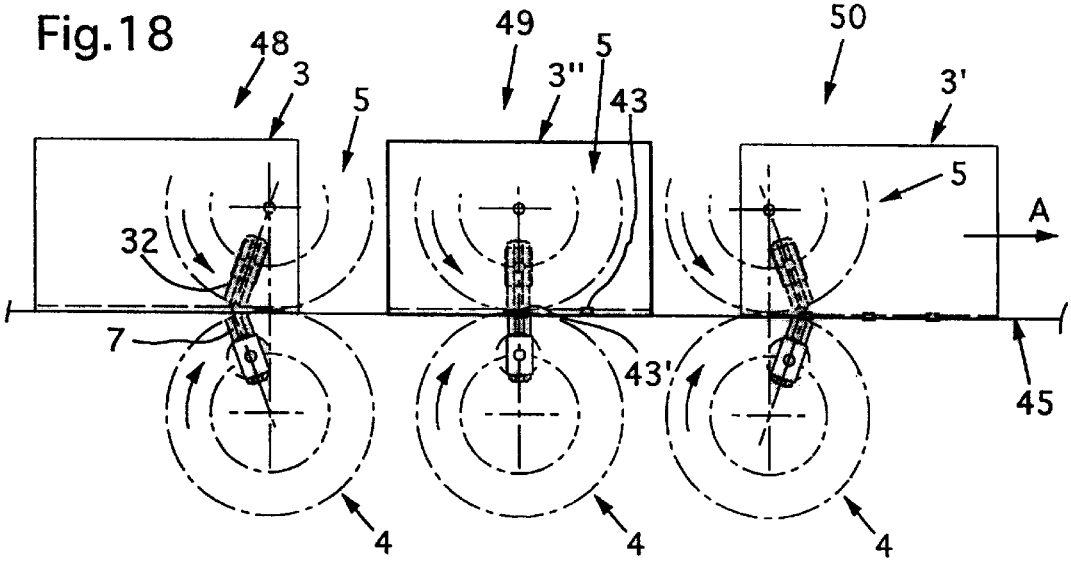
Figure 19:
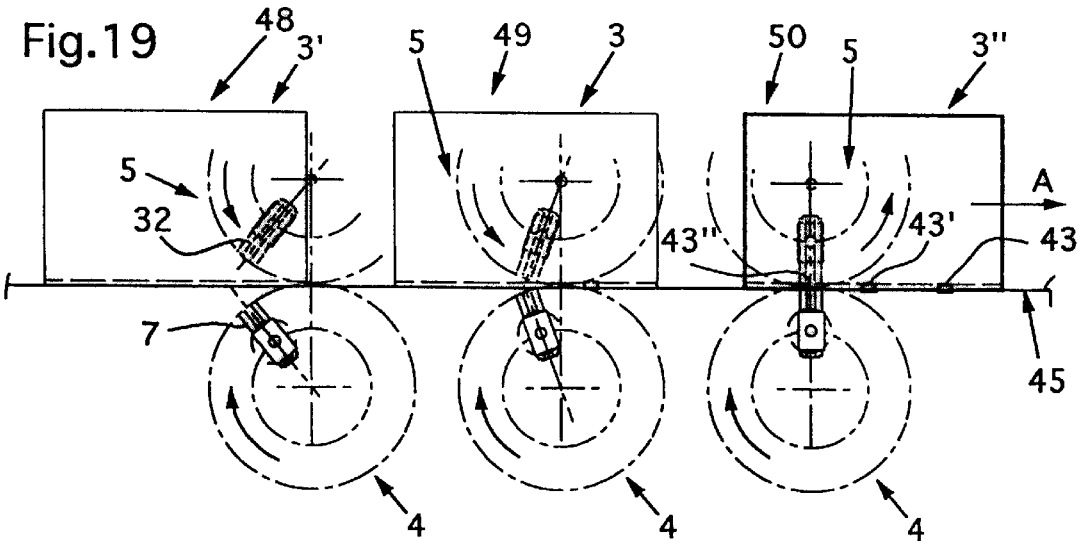

A variant of the stitching arrangement according to FIG. 16 is shown in various working phases in FIGS. 17–19.

Unlike the embodiment shown in FIG. 16, the three longitudinal stitchers 48, 49, 50 in the variant shown in FIGS. 17–19 do not work in synchronism with one another but with a mutual phase displacement. In the three FIGS. 17, 18 and 19, in each case the setting and closing of the three stitching hooks 43, 43', 43" is shown at a printed product 3". In the representation of FIG. 17, the stitching-hook setting and closing operations at the two leading printed products 3 and 3' have already been completed. FIG. 18 shows that the stitching-hook driving-in operation is starting at the longitudinal stitcher 48, while the longitudinal stitcher 50 has set the rearmost stitching hook of the product 3'. FIG. 19 shows that the longitudinal stitcher 50 is on the point of setting the rearmost stitching hook 43" in the product 3". The longitudinal stitcher 49 is at the start of the stitching-hook setting operation, while a stitching head 7 and the associated stitching-hook closing head 32 of the longitudinal stitcher 48 run toward the stitching region.

It can easily be seen from FIGS. 17–19 that the mutual phase position of the stitchers 48, 49, 50 may be set in order to take into account various parameters, such as, for example, product format, distance between successive products, stitching-hook distance, distance of the frontmost stitching hook from the leading product margin, etc.

Figure 20:
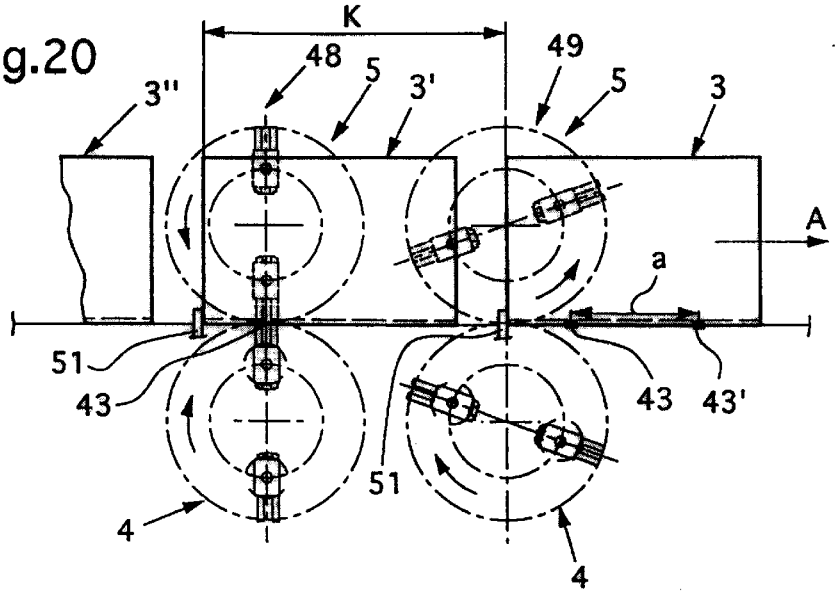
FIGS. 20–22 show a stitching arrangement with two longitudinal-stitching devices according to the invention in various working phases.

Two longitudinal stitchers 48 and 49, which, just as described with reference to FIGS. 17–19, do not work in synchronism but with a mutual phase displacement, are shown in the case of the stitching arrangements shown in FIGS. 20–22. In contrast to the stitching arrangement according to FIGS. 17–19, in the embodiment according to FIGS. 20–22 it is not the frontmost stitching hook but the rear stitching hook 43 which is set first by the first longitudinal stitcher 48 as viewed in the conveying direction A of the printed products 3.

Figure 21:
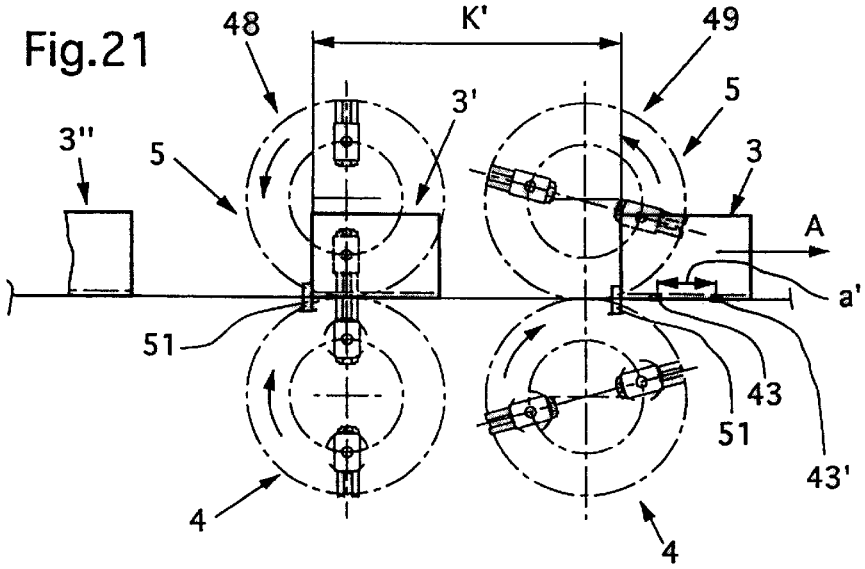
Figure 22:
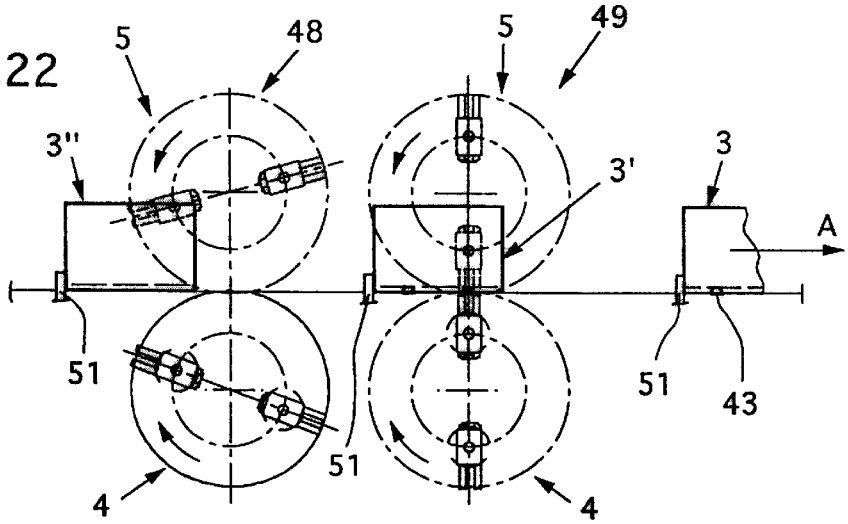

FIGS. 21 and 22 show how the two longitudinal stitchers 48 and 49 can be reset in order to convert the stitching arrangement to a smaller product format. The mutual phase position of the two stitchers 48 and 49 may be set, for example, in such a way that the distance a, a' between the two stitching hooks 43, 43' of a printed product 3 is changed. Furthermore, by changing the phase position of the two longitudinal stitchers 48, 49, a change in the product distance, which is determined by the distance K, K' of conveying lugs 51, can be taken into account.

Figure 23:
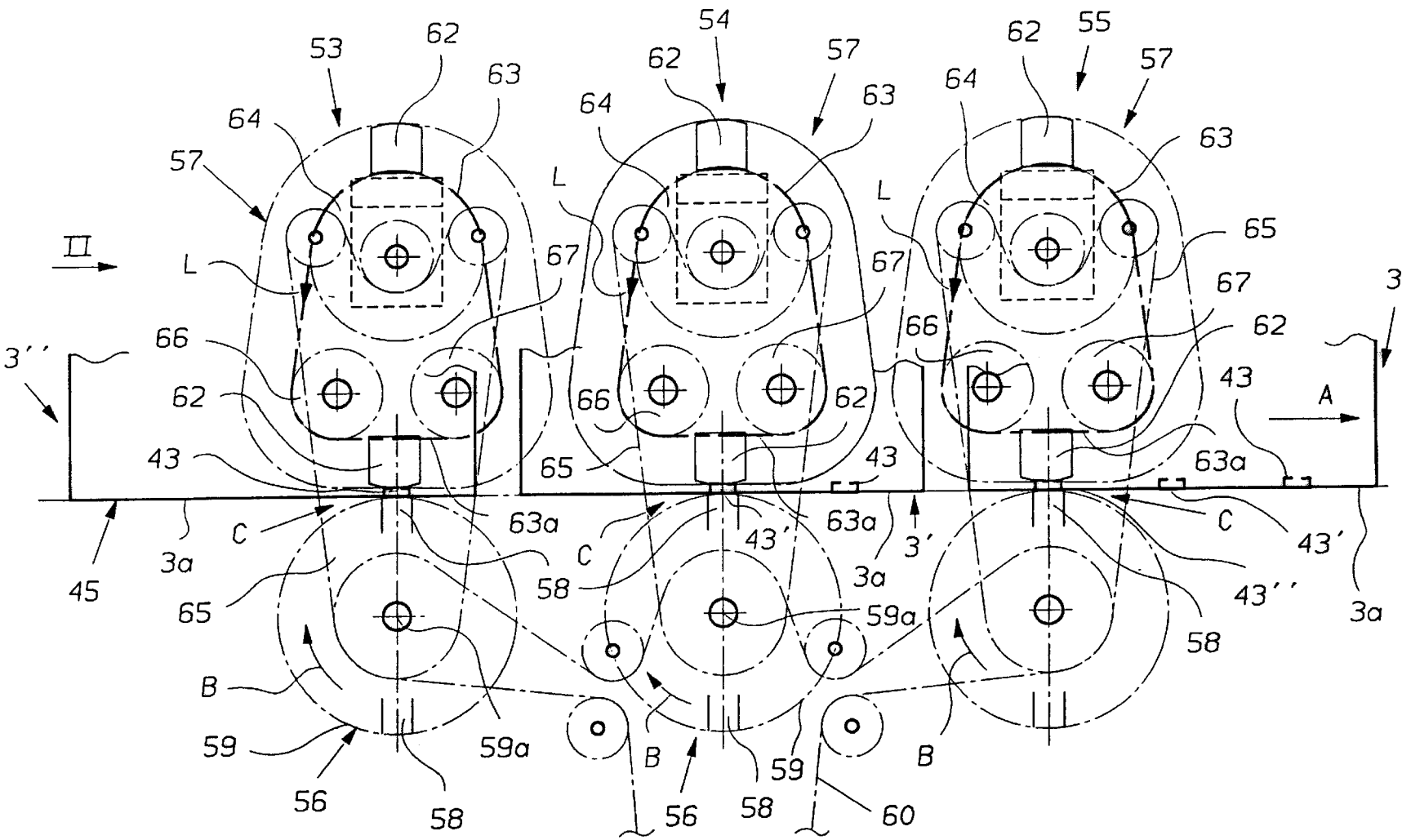
FIG. 23 shows in side view a stitching arrangement having a second embodiment of longitudinal-stitching devices according to the invention.
Figure 24:
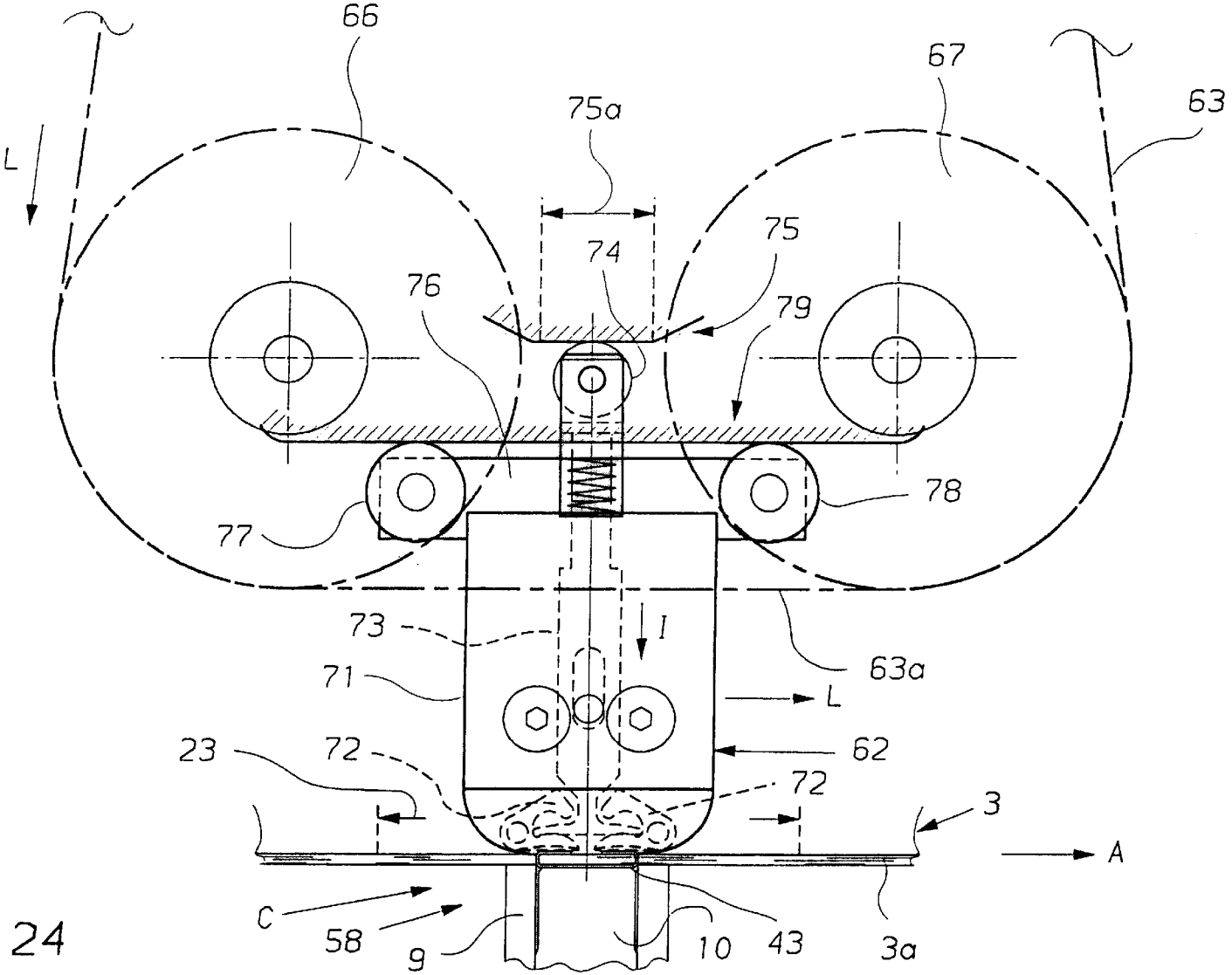
FIG. 24 shows part of the stitching-hook closing arrangement on an enlarged scale compared with FIG. 23, and FIG. 25 in a representation corresponding to FIG. 2, shows a longitudinal-stitching device of the type shown in FIG. 23 in front view and partly in section.
Figure 25:
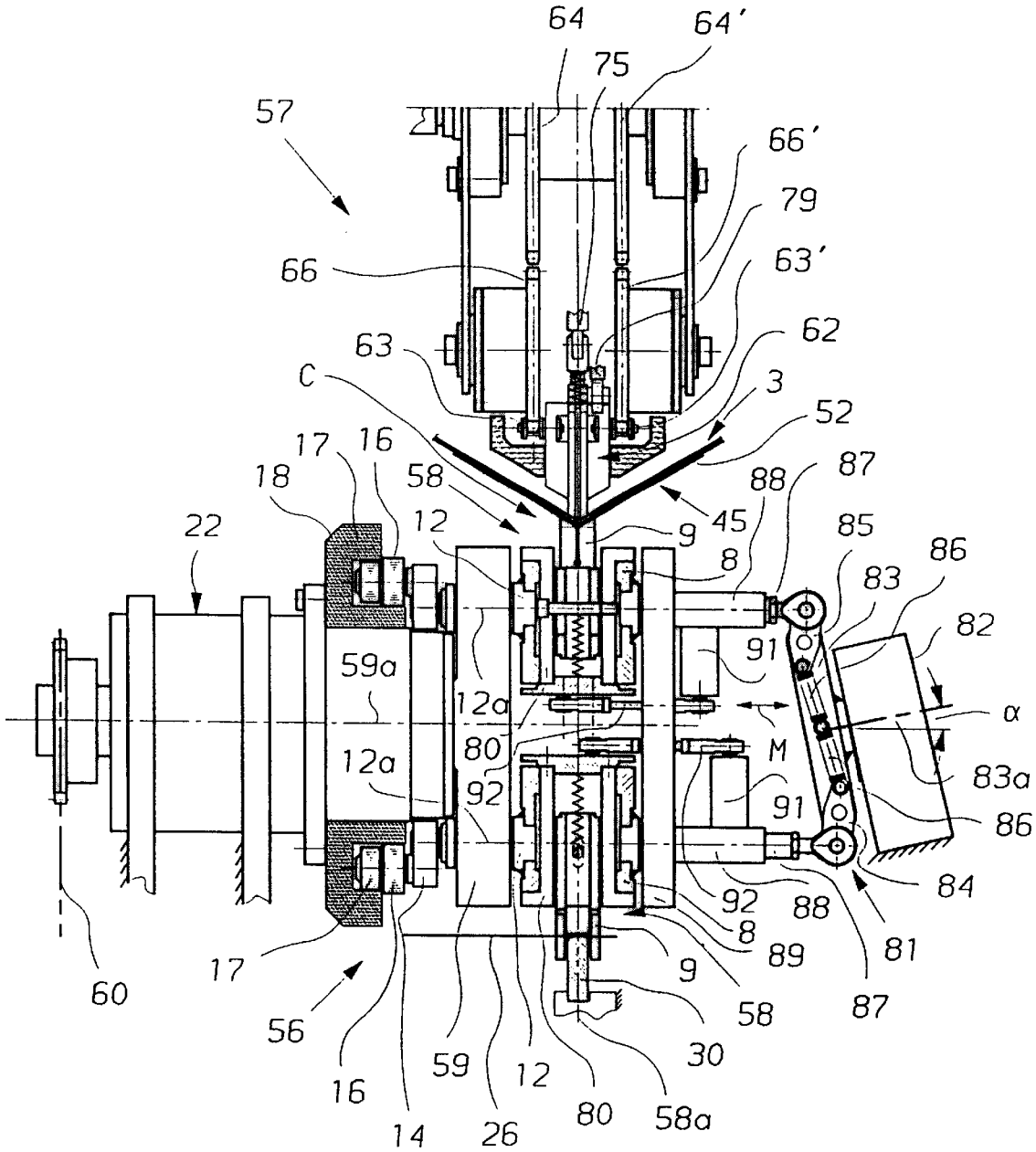

Shown in FIGS. 23–25 is another design of a stitching arrangement, which is very similar to the stitching arrangement according to FIG. 16. In the embodiment according to FIGS. 23–25 too, the printed products 3, 3', 3" to be stitched are moved along an insertion section 45 in the direction of arrow A. However, the longitudinal stitchers 53, 55 and 55 shown in FIG. 23 (side view) are of a different construction from the stitchers 48, 49, 50 of the embodiment according to FIG. 16, which of course correspond in design to the stitcher shown in FIGS. 1 and 2.

As seen in FIG. 25, which, in a representation comparable with FIG. 2 partly in section, shows a front view of the stitching arrangement according to FIG. 23 in the direction of arrow II in FIG. 23, the insertion section 45 has a V-shaped conveying channel 52 open at the top. The products 3, 3', 3" to be stitched lie on the side walls of this conveying channel 52. In the exemplary embodiment shown, three longitudinal stitchers 53, 54, 55 working in synchronism with one another are provided (FIG. 23), and these longitudinal stitchers, as explained with reference to FIG. 16, set a stitching hook 43, 43', 43" one after the other in each printed product 3, 3', 3". Each longitudinal stitcher 53, 54, 55 consists of a rotating stitcher 56, which is arranged below the conveying channel 52, and of a stitching-hook closing arrangement 57, which is arranged opposite the rotating stitcher 56 above the conveying channel 52.

As explained with reference to FIGS. 1 and 2, each rotating stitcher 56 has two diametrically opposite stitching heads 58, which are fastened to a carrier 59, which is rotationally driven in the direction of arrow B. The axis of rotation 59*a* of the carriers 59 runs at right angles to the conveying direction A of the printed products 3. The construction of the rotating stitchers 56 will be described in more detail with reference to FIG. 25. The carriers 59 of the three rotating stitchers 56 are driven together by a drive source (not shown in any more detail) via a drive chain or a drive belt 60.

The stitching-hook closing arrangements 57, of which a region is shown enlarged in FIG. 24, have two opposite stitching-hook closing heads 62, which are fastened to two chains 63 and 63' driven in a revolving manner (see also FIG. 25). The chains 63, 63' are each run over a drive wheel 64, 64'. The drive wheels 64, 64' are driven via drive chains or drive belts 65 by the associated rotating stitcher 56 (see FIG. 23). The revolving direction of the drive chains 63, 63' is designated by L in FIG. 23. The chains 63, 63' continue to run over two deflection wheels 66 (66') and 67, which are arranged next to one another in such a way that the strand 63*a* of the chains 63, 63' which runs between the two deflecting wheels 66, 67 extends parallel to the conveying direction A of the printed products 3, as can clearly be seen from FIGS. 23 and 24.

As FIG. 24 shows, each stitching-hook closing head 62 has a housing 71, in which two bending elements 72 are pivotably mounted, and these bending elements 72 interact with an actuating plunger 73, which is arranged in the housing 71 so as to be displaceable at right angles to the conveying direction A of the printed products 3, i.e. in the direction of arrow I. At its end opposite the bending elements 72, the actuating plunger 73 carries a control roller 74, which interacts with a control link 75 in the stitching region C shown in FIG. 24. The control link 75 has a linear section 75*a* which runs parallel to the conveying direction A. With regard to the arrangement and mode of operation of the deflecting elements 72 and the actuating plunger 73 with control roller 74, the stitching-hook closing heads 62 correspond to the stitching-hook closing heads 32 of the embodiment according to FIGS. 1 and 2. The housing 71 of the stitching-hook closing head is connected to a supporting element 76, which carries rollers 77 and 78 at its ends. These rollers 77, 78 run on a rectilinear, fixed guide rail 79, which runs parallel to the strand 63*a* of the chains 63 (63') and thus parallel to the conveying direction A of the printed products 3. The guide rail 79, which is only present in the stitching region C, serves as guide and support for the stitching-hook closing heads 62 during the stitching-hook setting and closing operation, which just as explained with reference to FIGS. 1 and 2 runs along a section 23 (FIG. 24), along which both the stitching heads 58 and the stitching-hook closing heads 62 perform a linear movement parallel to the conveying direction A of the printed products 3.

The construction and mode of operation of the rotating stitchers 56 and their stitching heads 58 will now be explained in more detail below with reference to FIG. 25. The rotating stitchers 56 are partly of the same construction as the rotating stitchers 4 of the embodiment according to FIGS. 1 and 2. In FIG. 25, therefore, those components which correspond to the components of the rotating stitcher 4 are provided with the same reference numerals as in FIGS. 1 and 2. The rotating carrier 59, on which the stitching heads 58 are pivotably mounted, is driven by a drive shaft 22, which is in operative connection with the drive chain or the drive belt 60. The mounting of the stitching heads 58 in the carrier 59 and the arrangement for pivoting the stitching heads 58 about the pivot axis 12*a* are effected exactly in the same way as described with reference to FIGS. 1 and 2. Mounted in the interior of the housing 8 of each stitching head 58 is a bush 80, which is rotatable about the longitudinal axis 58*a* of the associated stitching head 58. The stitching-hook guide 9 and the stitching-hook drive-in plunger 10 are displaceably mounted in the interior of this rotatable bush 80, as has already been explained with reference to FIGS. 1 and 2.

A rotary mechanism 81 common to both stitching heads 58 is provided in order to rotate the bearing bushes 80. The rotary mechanism 81 has a disk 83 mounted in a freely rotatable manner on a fixed bearing arrangement 82. This disk 83 is inclined relative to the axis of rotation 59*a* of the carrier 59, i.e. the axis of rotation 83*a* of the disk 83 forms an angle $\alpha$ with this axis of rotation 59*a*. Two double-armed levers 84, 85 diametrically opposite one another are pivotably mounted on the disk 83. Acting on one lever arm is a tension spring 86, which is fastened at the other end to the disk 83. The other lever arm of the levers 84, 85 is connected in an articulated manner to a lever 87, which is guided in a longitudinal guide 88, the longitudinal axis of which extends parallel to the axis of rotation 59*a*. These longitudinal guides 88 are fastened to a disk 89, which is connected to the stitching-head housings 8 and thus rotates in synchronism along with the stitching heads 58 and the carrier 59. Firmly connected to the plungers 87 and projecting away from the latter are actuating elements 91, which are each connected via a lever 92 to the rotatable bearing bush 80 of each stitching head 58. These levers 92 act on the bearing bushes 80 outside the axis of rotation 58*a* of the latter.

During the rotation of the carrier 59 and thus of the stitching heads 58, the disk 83 is driven along via the plungers 87 and is rotated about its axis 83*a*. Since the latter is inclined by the angle $\alpha$ relative to the axis of rotation 59*a* of the carrier 59, the plungers 87 and thus also the actuating elements 91 are moved in a reciprocating manner in the direction of arrow M during this rotary movement of the disk 83. Via the levers 92 acting eccentrically on the bearing bushes 80, this linear movement of the actuating elements 91 produces a rotation of the bearing bushes 80 by 90° during the movement of the stitching heads 58 from the stitching-wire transfer point to the stitching region. In the process, the feeding of the stitching wire 26, the preparation and transfer of wire sections, and the bending of the stitching hooks 43 are effected in the manner described with reference to FIGS. 1 and 2.

It follows from the above description of the embodiment according to FIGS. 23–25 that, just as described with reference to FIGS. 1–3, the stitching heads 58, before or when running into the stitching region C, are pivoted into a position in which the longitudinal axis 58*a* of the stitching heads and thus the displacing direction E of the stitching-hook drive-in plungers 10 are at right angles to the conveying direction A of the printed products 3. The stitching heads 58 are held in this position while passing through the section designated by 23. Correspondingly, the stitching-hook closing heads 62 are moved in the stitching region along the abovementioned section 23 likewise parallel to the conveying direction A of the printed products 3, i.e. the displacing direction I of the actuating plunger 73 is likewise at right angles to the abovementioned conveying direction A.

Therefore the advantages described with reference to FIGS. 1–3 are also obtained in the embodiment according to FIGS. 23–25.

Some of the different possible alternative designs of the longitudinal-stitching device according to the invention are referred to below.

Although the rotating stitcher 4, 56, as shown, has two stitching heads 7, 58, which are located diametrically opposite one another, it is also possible for only one stitching head or else for more than two stitching heads 7, 58 to be provided per rotating stitcher. If there are a multiplicity of stitching heads, these stitching heads may be arranged so as to be distributed in the circumferential direction of the carrier 6, 59 at uniform distances or else even at non-uniform distances.

If there are a plurality of stitching heads per rotating stitcher, it is also possible, depending on the range of use, for individual stitching heads not to be loaded with a wire section.

The preparation of stitching-wire sections and their feed to the revolving stitching heads may also be of a different design from that shown, e.g. in the manner described in U.S. Pat. No. 5,172,897.

The stitching-hook closing arrangement 5, 57 may be designed in a different way to that shown. As shown and described, however, a stitching-hook closing head is preferably assigned to each stitching head. However, this stitching-hook closing head may also be only an opposing element without controlled bending elements, and the stitching-hook legs are pressed against said opposing element and are bent in the process. Of course, within the scope of the invention, this opposing element must be moved in the stitching region along with the associated stitching head along a linear path of movement.

Instead of a revolving movement of the stitching-head closing heads or stitching-head closing opposing elements, a reciprocating movement of these components may also be provided.

What is claimed is:

1. A device for the longitudinal stitching of multipiece printed products which are conveyed in the direction of a longitudinal edge along a conveying path which is linear in the stitching region, comprising a rotating stitcher, which has a carrier which is rotationally driven about an axis running essentially at right angles to the conveying direction of the products and is provided with at least one stitching head for setting wire stitching hooks in the products in the direction of their longitudinal edge, the one stitching head having a guide which runs essentially in the radial direction relative to the axis of rotation of the carrier and in which a stitching-hook drive-in plunger is displaceably guided, and a stitching-hook closing arrangement assigned to the rotating stitching head and intended for closing the wire stitching hooks, wherein the guide of the one stitching head is attached to the carrier so as to be pivotable about a pivot axis parallel to the axis of rotation of the carrier, and the guide, before or when the one stitching head runs into the stitching region, is pivotable about the pivot axis by means of a control arrangement into a position in which the displacing direction of the stitching-hook driving-in plunger is essentially at right angles to the conveying direction of the products to be stitched and is then held in this position during a section along which the driving-in and closing of the wire stitching hooks take place, and wherein, during the stitching-hook closing operation, a bending member of the stitching-hook closing arrangement interacts with the one stitching head during its linear movement, the bending member running with the stitching head along a linear path of movement.

2. The device as claimed in claim 1, wherein at least one further stitching head is attached to the carrier at a distance from the one stitching head as viewed in the direction of rotation of the carrier, and this further stitching head likewise has an essentially radially running guide and a stitching-hook driving-in plunger displaceably guided in this guide, the guide of this at least one further stitching head, before or when the latter runs into the stitching region, being likewise pivotable by means of a control arrangement into a position in which the displacing direction of the stitching-hook driving-in plunger is essentially at right angles to the conveying direction of the products to be stitched and then being held in this position during a section along which the driving-in and closing of the wire stitching hooks take place, and, during the stitching-hook closing operation, a bending member of the stitching-hook closing arrangement also interacting with the at least one further stitching head during its linear movement, the bending member running with the at least one further stitching head along a linear path of movement.

3. The device as claimed in claim 1, wherein the guide of the one stitching head is connected to a journal, which is rotatably mounted in the carrier and is positioned to interact with a fixed cam path via a follower member.

4. The device as claimed in claim 1, wherein the one stitching head has a housing, which is pivotably attached to the carrier and in which the stitching-hook guide is guided so as to be displaceable in the direction of a longitudinal axis of the stitching head.

5. The device as claimed in claim 4, wherein a bush rotatable about the longitudinal axis of the stitching head is mounted in the housing, in which bush the stitching-hook guide and the stitching-hook drive-in plunger are arranged so as to rotate with said bush, and wherein a rotary mechanism for rotating the bush by 90° during the rotation of the carrier acts on the bush.

6. The device as claimed in claim 1, wherein the stitching-hook guide is guided so as to be displaceable in the direction of a longitudinal axis of the stitching head, and wherein the one stitching head is mounted so as to be rotatable by 90° about said longitudinal axis.

7. The device as claimed in claim 1, wherein a bending member is assigned to the one stitching head, and the bending member is driven in a revolving manner.

8. The device as claimed in claim 7, wherein the bending member is pivotably mounted on a second carrier which is rotationally driven about an axis which runs parallel to the axis of rotation of the carrier for the one stitching head, the bending member, while passing through the stitching region and during the interaction with the respectively associated stitching head, being held by means of a control arrangement in a position in which it performs a linear movement.

9. The device as claimed in claim 8, wherein the bending member is fastened to at least one drive element which is driven in a revolving manner and has in the stitching region a section parallel to the conveying direction of the printed products to be stitched, so that the bending member performs a linear movement during the interaction with the respectively associated stitching head.

10. The device as claimed in claim 8, wherein the bending member has two pivotable bending elements, which, in order to close the stitching hooks, can be pivoted from a rest position into an operative position by means of a controlled actuating plunger.

11. The device as claimed in claim 1, wherein a stitching-wire feed unit is arranged in a stationary position on the revolving path of the one stitching head and so as to deliver a wire section to the one stitching head running past at a wire-transfer point.

12. The device as claimed in claim 11, wherein the stitching-wire feed unit delivers straight wire sections, and wherein a fixed wire-bending link is arranged downstream of the wire-transfer point as viewed in the direction of rotation of the carrier, by means of which wire-bending link the straight wire sections are bent into U-shaped wire stitching hooks when the stitching heads run past.

13. An apparatus comprising two or more of said longitudinal stitching devices as defined in claim 15, of which each comprises a rotating stitcher and an associated stitching-hook closing arrangement arranged one behind the other as viewed in the conveying direction of the printed products, the stitchers being longitudinally positioned for driving in and closing wire stitching hooks in a synchronous manner or with a phase displacement.

14. The device as claimed in claim 13, wherein each of the longitudinal stitching devices in each case attaches only one wire stitching hook to a certain printed product to be stitched repeatedly.

* * * * *

UNITED STATES PATENT AND TRADEMARK OFFICE

CERTIFICATE OF CORRECTION

PATENT NO. : 6,223,964 B1
DATED : May 1, 2001
INVENTOR(S) : Müller

It is certified that error appears in the above-identified patent and that said Letters Patent is hereby corrected as shown below:

Column 1,
Line 57, cancel "guide together with the", second occurrence.

Column 12,
Line 36, "claim 15" should read -- claim 1 --.

Signed and Sealed this

Eighteenth Day of December, 2001

*Attest:*

*Attesting Officer*

JAMES E. ROGAN
*Director of the United States Patent and Trademark Office*